US007040517B1

(12) United States Patent
Swanson

(10) Patent No.: US 7,040,517 B1
(45) Date of Patent: May 9, 2006

(54) HAT HANGER

(76) Inventor: Stanly T. Swanson, 3491 St. James Church Rd., Newton, NC (US) 28658

( * ) Notice: Subject to any disclaimer, the term of this patent is extended or adjusted under 35 U.S.C. 154(b) by 13 days.

(21) Appl. No.: 10/977,663

(22) Filed: Oct. 29, 2004

(51) Int. Cl.
*A41D 27/22* (2006.01)

(52) U.S. Cl. ..... 223/85

(58) Field of Classification Search ..... 223/85, 223/97, DIG. 1–DIG. 4; 2/160, 304, 323, 2/326; 24/298, 300, 301, 302, 3.13; 224/268, 224/269; 248/499, 500; 211/113
See application file for complete search history.

(56) References Cited

U.S. PATENT DOCUMENTS

| | | | | |
|---|---|---|---|---|
| 887,401 | A | 5/1908 | Klotz | |
| 1,009,522 | A * | 11/1911 | Hunter | 223/90 |
| 2,432,957 | A * | 12/1947 | Webster | 211/113 |
| 3,999,821 | A | 12/1976 | Moody et al. | |
| 4,071,146 | A | 1/1978 | Batts | |
| 4,673,153 | A * | 6/1987 | Hilty et al. | 248/231.81 |
| 4,767,012 | A | 8/1988 | Simmons | |
| 4,778,088 | A * | 10/1988 | Miller | 223/91 |
| 4,927,063 | A | 5/1990 | Fricano | |
| 5,002,190 | A | 3/1991 | Moreland | |
| 5,038,941 | A | 8/1991 | Bastiaansen | |
| 5,117,988 | A | 6/1992 | Daniels | |
| 5,118,065 | A * | 6/1992 | Becklund et al. | 248/316.5 |
| 5,121,842 | A | 6/1992 | Osborne | |
| 5,188,325 | A | 2/1993 | Hilty et al. | |
| 5,351,346 | A * | 10/1994 | Hodges, Jr. | 4/605 |
| 5,566,837 | A | 10/1996 | Lema | |
| 5,601,197 | A * | 2/1997 | Baxter | 211/117 |
| 5,722,125 | A * | 3/1998 | Vasilopoulos | 24/301 |
| 5,967,341 | A | 10/1999 | Werner | |
| 6,006,929 | A | 12/1999 | Leonard | |
| 6,076,714 | A * | 6/2000 | Wyenn | 223/85 |
| 6,161,703 | A * | 12/2000 | Mihok | 211/31 |
| 6,425,167 | B1 * | 7/2002 | Barbarite et al. | 24/298 |
| 6,530,488 | B1 | 3/2003 | Krammes, Jr. | |
| 2003/0150827 | A1 | 8/2003 | Blumereich et al. | |

* cited by examiner

*Primary Examiner*—Gary L. Welch
(74) *Attorney, Agent, or Firm*—Adams Evans P.A.

(57) ABSTRACT

A hat hanger for hanging hats and the like. The hanger including a flexible support cord; at least one hook on one end of the support cord; and at least one elongate attachment cord. The hook is carried on a first end of the support member for suspending the support member from a support. The attachment cord is secured to the support cord for suspending a hat or the like therefrom.

17 Claims, 5 Drawing Sheets

HAT HANGER

TECHNICAL FIELD AND BACKGROUND OF THE INVENTION

This invention relates to a flexible hat hanging device that can be for example, suspended in a closet or carried in a suit case for hanging various types of hats. Even though the application discloses a hat hanging device, the invention is not limited to hanging hats and may be used to hold and suspend other objects.

Hat hanging devices of varying forms are well-known in the art. Many hat hangers are made for a specific type of hat, such as a baseball cap. For example, U.S. Pat. No. 5,188,325 to Hilty et al. discloses a cap suspension device. The cap suspension device has an engagement member for engaging a button positioned on top of the baseball cap.

U.S. Pat. No. 6,530,488 to Krammes, Jr. discloses a fishing lure holder and display for tackle boxes and boats. The fishing lure holder has a hanging rod mounted to a support member in a horizontal orientation for suspending storage receptacles.

While these prior art patents disclose devices that are capable of holding and suspending hats or other objects, they do not disclose a flexible hanging device that can be suspended vertically or horizontally from various types of supports, that has a support member that can be stretched to greater than its normal length, that has an adjustable, flexible, and removable attachment member, or that can be folded and put in a suitcase when traveling.

Accordingly, there is a need for a flexible hanging device that can be placed or stored in a multitude of places for supporting, displaying, and organizing various hats or other objects.

SUMMARY OF THE INVENTION

Therefore, it is an object of the invention to provide a hat hanger that is flexible.

It is another object of the invention to provide a hat hanger that can be suspended in a vertical position.

It is another object of the invention to provide a hat hanger that can be suspended in a horizontal position.

It is another object of the invention to provide a hat hanger that is capable of hanging a variety of hats or other objects.

It is another object of the invention to provide a hat hanger that can be carried in a suitcase when traveling.

These and other objects of the present invention are achieved in the preferred embodiments disclosed below by providing a hanger for hanging hats and the like, including a flexible elongate support member; at least one suspension device carried on a first end of the support member for suspending the support member from a support; and at least one elongate attachment cord secured to the support member for suspending a hat or the like therefrom.

According to another preferred embodiment of the invention, the at least one suspension device is a hook.

According to another preferred embodiment of the invention, the hat hanger further including a clamp positioned on the support member, wherein the at least one attachment cord includes a hook on one end for engaging and being supported by the clamp.

According to another preferred embodiment of the invention, the at least one attachment cord includes a clip for engaging and securing the hats and the like to the attachment cord.

According to another preferred embodiment of the invention, the clamp is a hose-type clamp for being positioned on the support member.

According to another preferred embodiment of the invention, the clamp includes a pair of outwardly-extending fingers for expanding the clamp for allowing the clamp to be moved along the support member.

According to another preferred embodiment of the invention, a hanger for hanging hats and the like, including a flexible elongate support member; at least one suspension device carried on a first end of the support member for suspending the support member from a support; at least one flexible elongate attachment cord secured to the support member, the attachment cord having a clip for engaging and securing hats and the like to the attachment cord; and at least one clamp positioned on the support member, wherein the attachment cord is secured to the support member by the clamp.

According to another preferred embodiment of the invention, a hanger for hanging hats and the like, including a flexible and stretchable elongate support member; a pair of hooks, the hooks being carried on opposite ends of the support member for suspending the support member from a support; a plurality of flexible elongate attachment cords secured to the support member, each of the attachment cords having an attachment hook on one end of the attachment cord and a clip disposed on an opposite end of the attachment cord, wherein the clip engages and secures hats and the like to the attachment cord; and a plurality of clamps positioned on the support member, wherein the attachment hook is secured to the support member by respective ones of the clamps.

According to another preferred embodiment of the invention, the attachment hook is positioned between the clamp and the support member for securing the attachment cord to the support member.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
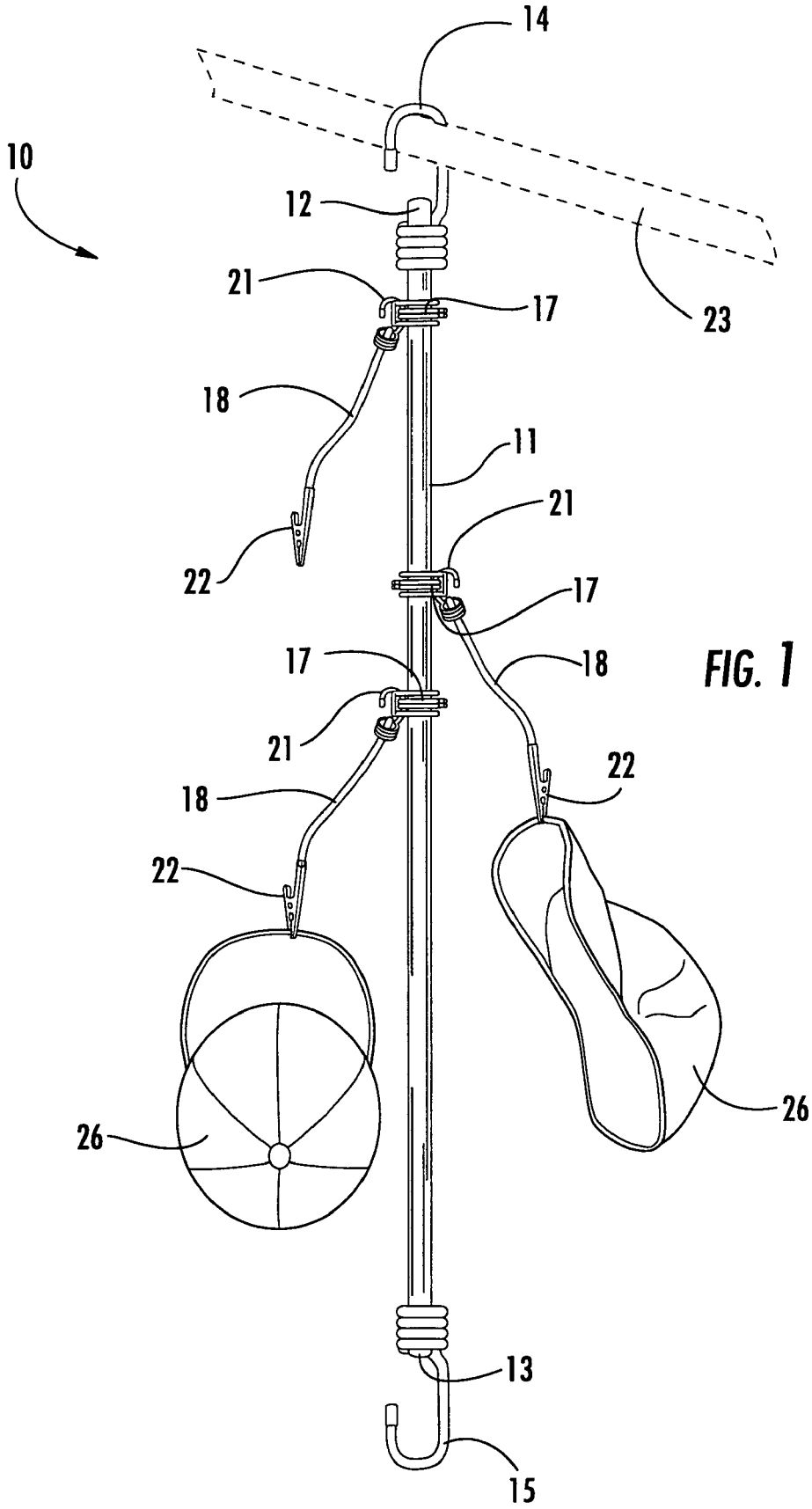
FIG. 1 shows an environmental view of a hat hanger suspended in a vertical orientation.
Figure 2:
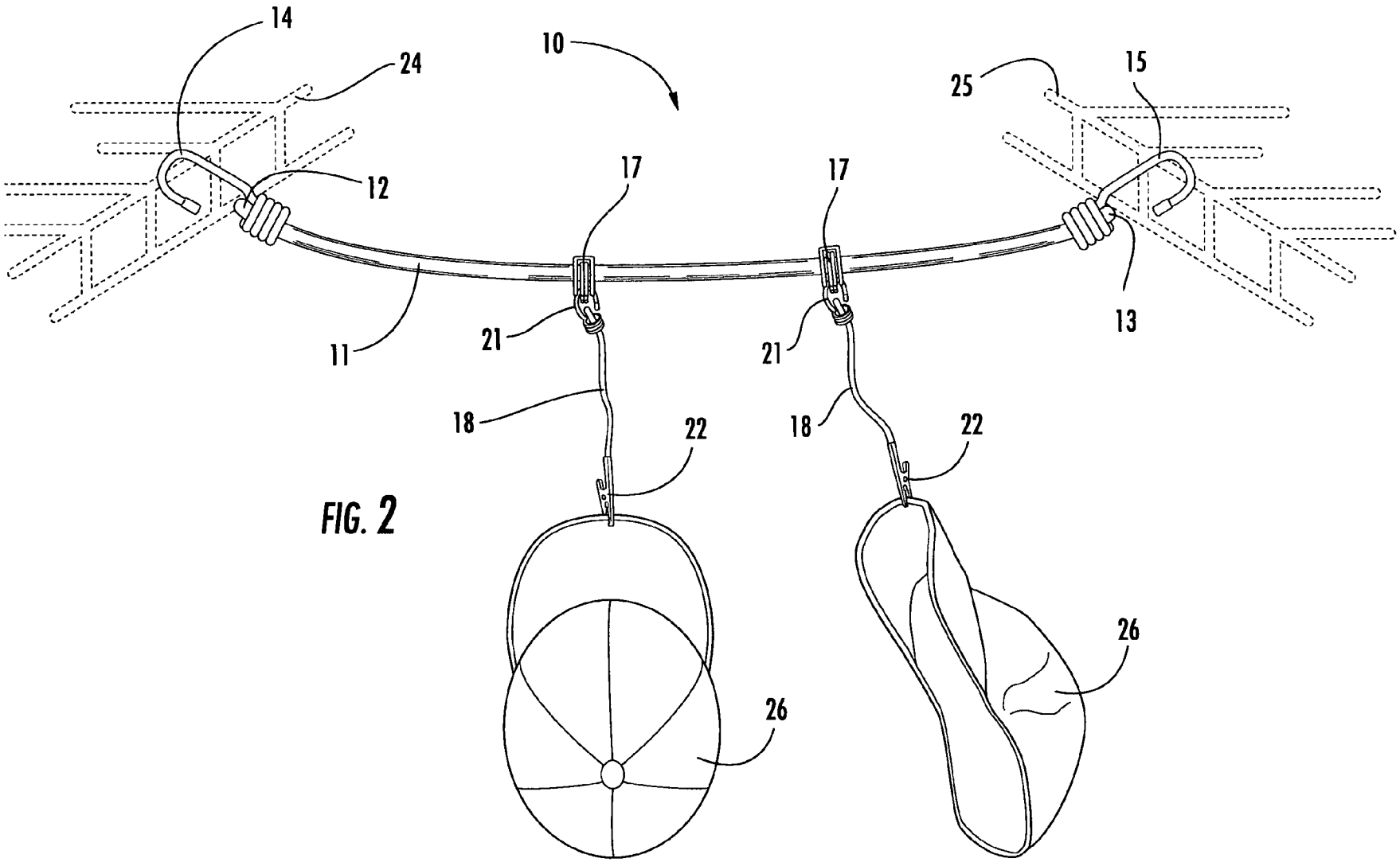
FIG. 2 shows an environmental view of the hat hanger suspended in a horizontal orientation.

Referring now specifically to the drawings, a hat hanger according to an embodiment of the present invention is illustrated in FIGS. 1 and 2 and shown generally at reference numeral 10.

The hat hanger 10 includes an elongate support member, preferably comprising a flexible and stretchable material, such as a shock or elastic-type cord 11 having a first end 12 and second end 13.

A pair of suspension devices in the form of hooks 14 and 15 are attached to the opposite ends 12 and 13 of the cord 11. A plurality of spring-biased hose-type clamps 17 are positioned in a spaced-apart relation along the cord 11. The clamps 17 are slidably attached to the cord 11 to allow the clamps 17 to be positioned in desired locations along the cord and to permit a change in the spacing between the clamps 17.

Elongate attachment cords 18 are secured by respective ones of the clamps 17 to the cord 11. The attachment cords 18 are preferably shock or elastic-type cords. One end of each cord 18 is secured to the cord 11 by a clamp 17. The opposite end of the cord 18 is secured to a spring-biased clip 22, such as an alligator clip, for holding a hat 26, as illustrated, or any other object desired to be suspended.

Figure 3:
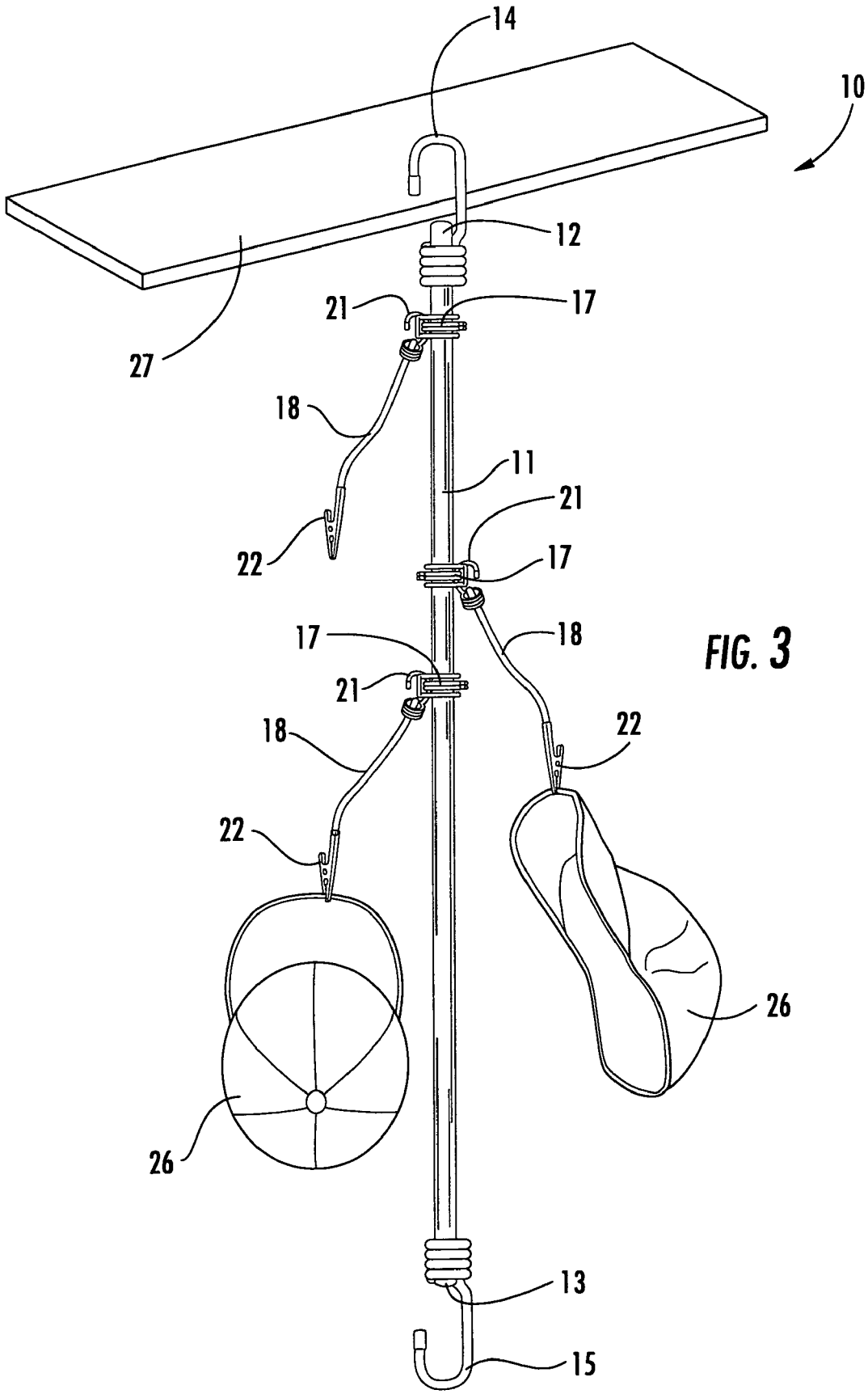
FIG. 3 shows an environmental view of the hat hanger suspended in a vertical orientation from a flat surface.

The flexibility of the cord 11 allows the hat hanger 10 to be suspended or stored in a variety of configurations. As shown in FIG. 1, the hat hanger 10 can be suspended vertically from a support 23 by the hook 14 or suspended horizontally from a pair of supports 24 and 25 using hooks 14 and 15, as illustrated in FIG. 2. The cord 11 may also be suspended from a flat surface, such as a shelf 27, by the hook 14 as illustrated in FIG. 3. This is accomplished by providing a point, non-skid material, or other suitable means on the end of the hook 14 to prevent the hook 14 from sliding off of the shelf 27.

The optional stretchability of the cord 11 also allows the hat hanger 10 to be stretched between spaced-apart supports further apart than the unstretched length of the hat hanger 10.

Figure 4:
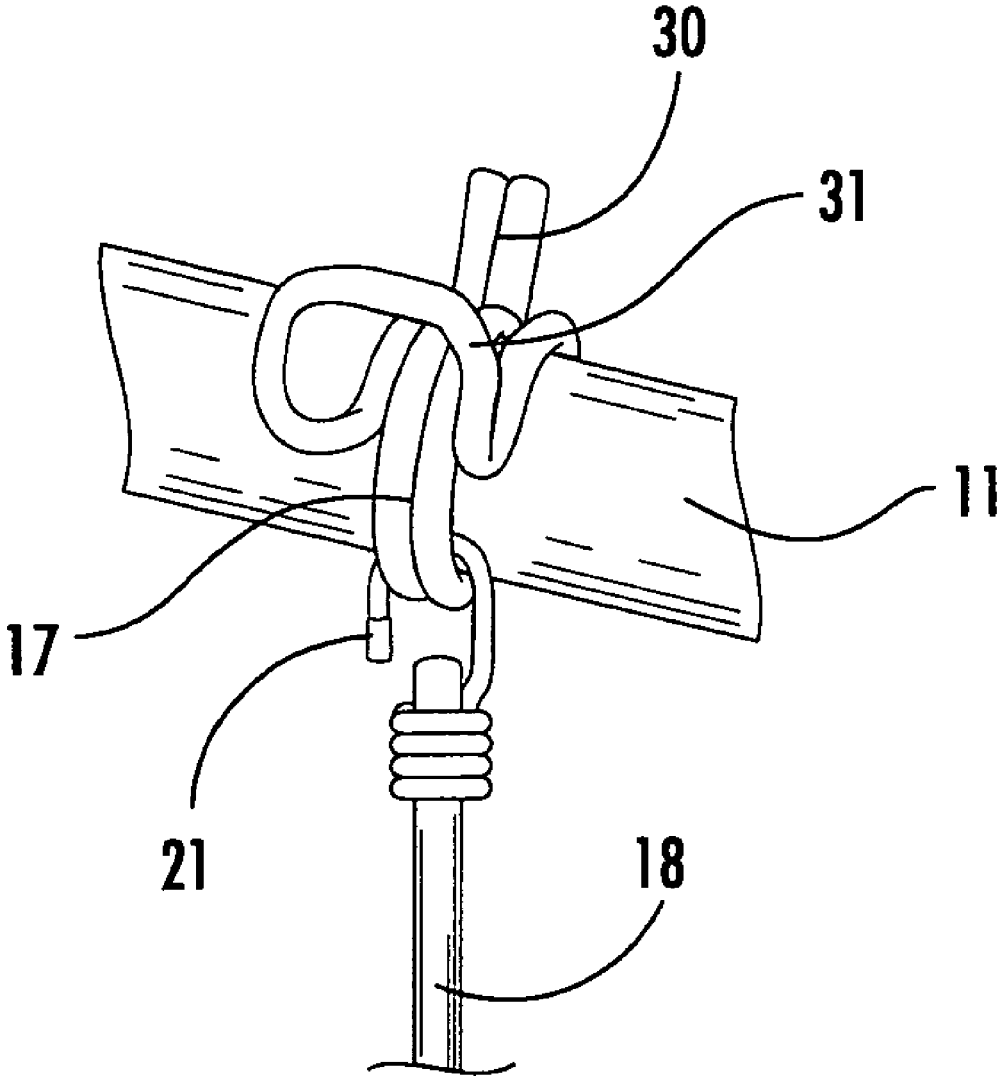
FIG. 4 shows a detail of an attachment cord attached to a support member of the hat hanger by a clamp.

Referring to FIG. 4, the clamp 17 normally fits tightly around the cord 11. The clamp 17 has a pair of outwardly-extending fingers 30 and 31 for allowing the clamp 17 to be spread, releasing the clamp 17 from engagement with the cord 11. By depressing the fingers 30 and 31, the clamp 17 can be moved along the cord 11 to a desired position. The clamp 17 is then secured to the cord 11 by releasing the fingers 30 and 31 of the clamp 17 and allowing the clamp 17 to compress around the cord 11.

The cords 18 are secured to the cord 11 by depressing the fingers 30 and 31 and inserting the hook 21 between the clamp 17 and the cord 11. The fingers 30 and 31 of the clamp 17 are then released allowing the clamp 17 to compress and secure the cord 18 to the cord 11 at a desired position. Alternatively, the cord 18 can be secured to cord 11 by attaching the hook 21 to finger 31.

Figure 5:
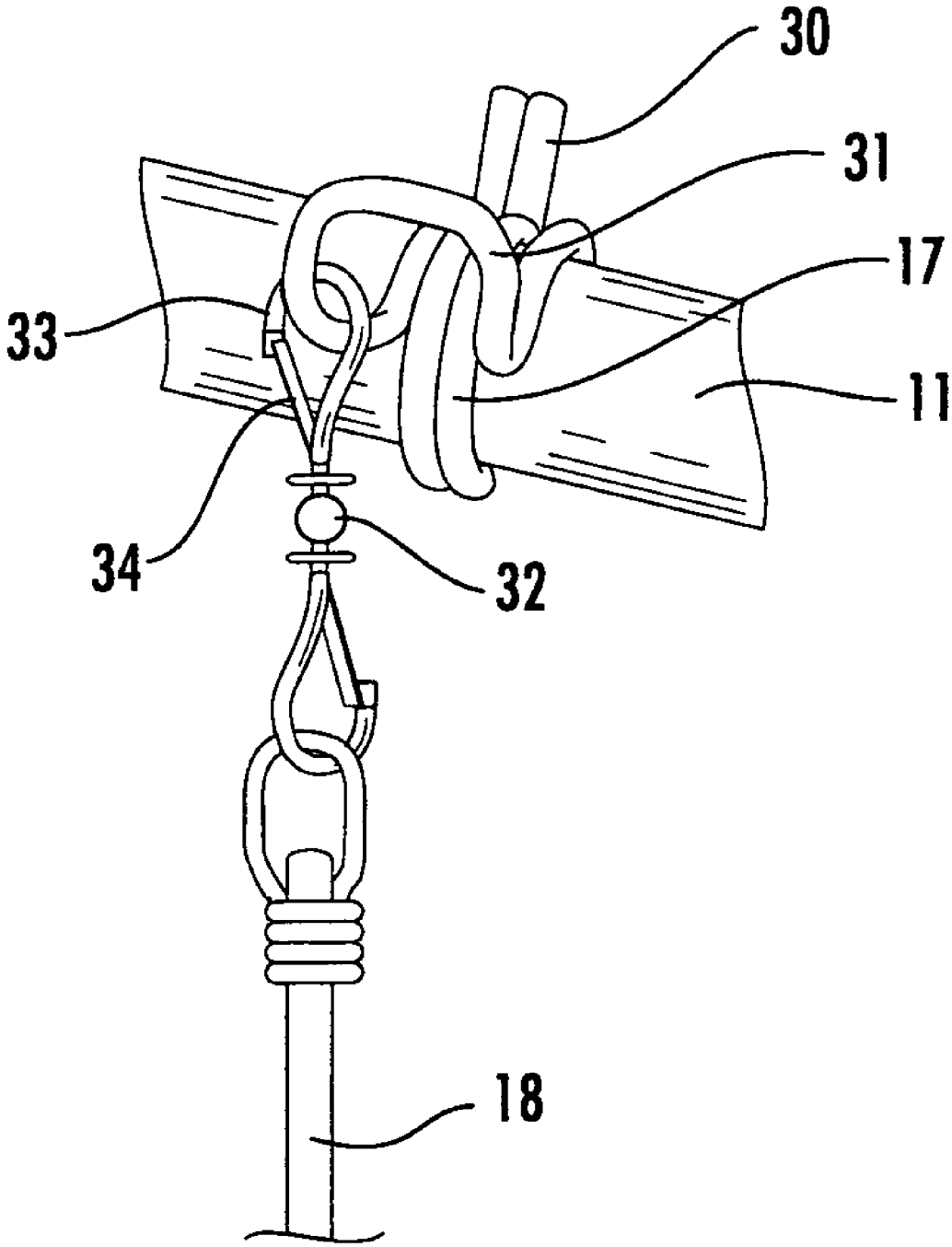
FIG. 5 shows a detail of an attachment cord attached to a support member of the hat hanger by a clamp.

Referring to FIG. 5, a swivel 32 may be used to secure the cords 18 to the cord 11. The swivel 32 provides additional flexibility and adjustability to the cords 18. A swivel (not shown) may also be positioned between the cord 18 and clip 22 to add even more flexibility. The swivel 32 is attached to the finger 31 of the clamp 17 with a hook 33. The hook 33 provides a quick release 34 for removing the hook 33 and attachment cord 18 from finger 31.

A hat hanging device is described above. Various details of the invention may be changed without departing from its scope. Furthermore, the foregoing description of the preferred embodiments of the invention and the best mode for practicing the invention are provided for the purpose of illustration only and not for the purpose of limitation, the invention being identified in the claims.

I claim:

1. A hanger for hanging hats and the like, comprising:

(a) a flexible elongate support member;

(b) at least one suspension device carried on a first end of the support member for suspending the support member from a support;

(c) at least one elongate attachment cord secured to the support member for suspending a hat or the like therefrom; and (d) a means for selectively retaining the at least one elongate attachment cord at a fixed position along the support member.

2. The hanger according to claim 1, wherein the at least one suspension device is a hook.

3. The hanger according to claim 1, wherein the means for selectively retaining the at least one attachment cord is a clamp moveable from a release position to a clamped position.

4. The hanger according to claim 3, wherein the at least one attachment cord includes a hook on one end for engaging and being supported by the clamp.

5. The hanger according to claim 3, wherein the at least one attachment cord includes a swivel on one end for engaging and being supported by the clamp.

6. The hanger according to claim 1, wherein the at least one attachment cord includes a clip for engaging and securing the hats and the like to the attachment cord.

7. The hanging apparatus according to claim 3, wherein the clamp is a hose-type clamp.

8. The hanging apparatus according to claim 7, wherein the clamp includes a pair of outwardly-extending fingers for expanding the clamp for allowing the clamp to be moved along the support member to a desired position and spacing.

9. A hanger for hanging hats and the like, comprising:

(a) a flexible elongate support cord;

(b) at least one hook carried on a first end of the support cord for suspending the support cord from a support;

(c) at least one flexible elongate attachment cord secured to the support cord, the attachment cord having a clip on one end for engaging and securing hats and the like to the attachment cord; and (d) at least one clamp positioned on the support cord, the clamp being selectively moveable from a released position where the clamp is slidable along the support cord to a clamped position where the clamp is secured to the support cord, wherein the attachment cord is secured to the support cord by the clamp.

10. The hanger according to claim 9, wherein the at least one attachment cord includes a hook positioned on one end for engaging and being supported by the clamp.

11. The hanger according to claim 9, and further comprising at least one swivel attached to one end of the at least one attachment cord for engaging and being supported by the clamp.

12. The hanging apparatus according to claim 9, wherein the clamp is a hose-type clamp for fitting around and compressing the support cord.

13. The hanging apparatus according to claim 12, wherein the clamp includes a pair of outwardly-extending fingers for expanding the clamp for allowing the clamp to be moved along the support cord.

14. A hanger for hanging hats and the like, comprising:

(a) a flexible and stretchable elongate support cord;

(b) a pair of hooks, the hooks being carried on opposite ends of the support cord for suspending the support cord from a support;

(c) a plurality of flexible elongate attachment cords secured to the support cord, each of the attachment cords having an attachment hook on one end of the attachment cord and a clip disposed on an opposite end of the attachment cord, wherein the clip engages and secures hats and the like to the attachment cord; and (d) a plurality of clamps positioned on the support cord, wherein the attachment hook is secured to the support cord by respective ones of the clamps.

15. The hanger according to claim 14, wherein the clamp is a hose-type clamp for fitting around and compressing the support cord.

16. The hanger according to claim 15, wherein the clamp includes a pair of outwardly-extending fingers for expanding the clamp for allowing the clamp to be moved along the support cord.

17. The hanging apparatus according to claim 15, wherein the attachment hook is positioned between the clamp and the support cord for securing the attachment cord to the support cord.

* * * * *